US007412985B2

(12) United States Patent
Ma

(10) Patent No.: US 7,412,985 B2
(45) Date of Patent: Aug. 19, 2008

(54) UMBRELLA WITH ROTATION MECHANISM

(76) Inventor: Oliver Joen-an Ma, 29 W. Wisteria, Arcadia, CA (US) 91007

( * ) Notice: Subject to any disclaimer, the term of this patent is extended or adjusted under 35 U.S.C. 154(b) by 447 days.

(21) Appl. No.: 11/063,234

(22) Filed: Feb. 22, 2005

(65) Prior Publication Data

US 2005/0268953 A1 Dec. 8, 2005

(30) Foreign Application Priority Data

Jun. 8, 2004 (CN) ..... 2004 2 0023521 U

(51) Int. Cl.
*A45B 17/00* (2006.01)
*A45B 25/14* (2006.01)

(52) U.S. Cl. ..... 135/20.3; 135/20.1; 135/98; 242/395

(58) Field of Classification Search ..... 135/20.3, 135/20.1, 98, 90; 242/395; 116/173
See application file for complete search history.

(56) References Cited

U.S. PATENT DOCUMENTS

| | | | | |
|---|---|---|---|---|
| 2,475,406 | A | 7/1949 | Russell | |
| 3,145,720 | A | 8/1964 | Torii | |
| 4,586,525 | A | 5/1986 | Glatz et al. | |
| 4,622,987 | A | 11/1986 | Redl et al. | |
| 4,674,523 | A | 6/1987 | Glatz | |
| 4,878,509 | A | 11/1989 | Tung | |
| 5,002,081 | A | 3/1991 | Stromeyer | |
| 5,029,596 | A | 7/1991 | Tung | |
| 5,349,975 | A | 9/1994 | Valdner | |
| 5,584,564 | A | 12/1996 | Phyle | |
| 5,785,069 | A | 7/1998 | Glatz | |
| D398,443 | S | 9/1998 | Bolle | |
| 5,868,152 | A | 2/1999 | Brown | 135/31 |
| 5,937,882 | A | 8/1999 | Harbaugh | |
| 6,014,980 | A | 1/2000 | Glatz | |
| 6,152,156 | A | 11/2000 | Tung | |
| 6,220,261 | B1 | 4/2001 | Glatz | |
| 6,311,705 | B1 | 11/2001 | Ma | |
| 6,330,886 | B1 | 12/2001 | Culver | 135/15.1 |
| 6,478,037 | B2 | 11/2002 | Tung | |
| 6,575,182 | B2 | 6/2003 | Tung | |
| 6,575,183 | B2 | 6/2003 | Tung | |
| 6,588,438 | B1 | 7/2003 | Steiner | |
| 6,619,306 | B2 | 9/2003 | Ma | |
| 6,662,815 | B2 | 12/2003 | Tung | |
| 6,837,255 | B2 | 1/2005 | Bunch et al. | |
| 6,851,823 | B2 | 2/2005 | Bilotti | |
| 2004/0031513 | A1 | 2/2004 | Bunch et al. | |
| 2004/0055627 | A1 | 3/2004 | Moga | |

(Continued)

OTHER PUBLICATIONS

Operation Manual Easy Sun Parasol Sunshade (Issue: Jul. 2004) pp. 1-17.

*Primary Examiner*—Winnie Yip
(74) *Attorney, Agent, or Firm*—Knobbe Martens Olson & Bear LLP

(57) ABSTRACT

An umbrella is provided that includes a lower pole portion, an upper pole portion, a canopy coupled with the upper pole portion, a crank, and a rotation mechanism. The upper pole portion is rotatably coupled with the lower pole portion. The crank is configured to articulate the canopy. The rotation mechanism is configured to apply a force to the upper pole portion. The rotation mechanism is at least partially located between the crank and the lower pole portion.

32 Claims, 4 Drawing Sheets

U.S. PATENT DOCUMENTS

2004/0055628 A1 3/2004 Yu
2004/0069333 A1 4/2004 Ma
2004/0182429 A1 9/2004 Chen

UMBRELLA WITH ROTATION MECHANISM

RELATED APPLICATION

This application claims priority under 35 U.S.C. §119(a) to Chinese parent Application No. 200410025699.3, filed Jun. 24, 2004, and to Chinese Utility Model No. 200420023521.0, filed Jun. 8, 2004.

BACKGROUND OF THE INVENTION

1. Field of the Invention

This application relates to a structure for providing shelter from the elements, such as an umbrella, and mechanisms for altering where such shelter is provided, particularly as conditions change.

2. Description of the Related Art

Umbrellas have been developed to provide shelter from the elements and are particularly useful in outdoor seating areas, such as on a backyard patio. Typically, an umbrella comprises a support pole and a retractable canopy positioned at the top of the pole for providing shade. Basic umbrellas have a canopy fixed in a plane perpendicular to the axis of the support pole. However, such umbrellas have limited ability to place the shade where it is desired. The position of the sun varies throughout the day and the year. In some umbrellas, an upper portion of the pole is tiltable so that the canopy can also be tilted to respond to variation in the sun's position during a day. Such umbrellas only tilt in one or two directions and in the same plane with respect to the pole. It is highly desirable to provide more flexibility in where the shade may be placed by having not only such tilting ability, but also some rotation about the vertical axis defined by the umbrella pole. A few umbrella designs enable rotation of an upper portion of an umbrella about a vertical axis to respond to variation in the sun's position.

For example, U.S. Pat. No. 6,575,183 discloses a sunshade for which an upper portion can rotate relative to the ground. The sunshade of the '183 patent comprises a post consisting of an upper supporting tube, a lower supporting tube, a canopy frame mounted to the upper supporting tube, and a device for rotating the canopy frame relative to the ground. The canopy is mounted on a rod which is pivotally mounted via a joint to the upper support pole. The rotating device has a complex structure that includes a sleeve that is movable downward to disengage a clutch mechanism to enable rotation of the sleeve. Rotation of the sleeve in turn causes rotation of four gear members mounted inside the sleeve. Rotation of the four gear members causes rotation of an elongated internal tube, which, in turn, causes rotation of the joint and thereby the canopy. Thus the elongated internal tube transmits the torque of the sleeve upward over a significant distance. The '183 patent sunshade also includes a canopy operating crank mechanism, which includes a spool, and a cable that extends upwardly to the canopy.

The foregoing construction is disadvantageous in several aspects. First, the elongated internal tube is subject to strain due to its length and the turning force it applies to the joint to turn the relatively large and heavy canopy. Also, as discussed above, the sleeve and associated force transmission member are located above the crank mechanism that operates the canopy frame. The arrangement of these components requires the cable of the crank mechanism to be threaded through various clutch and torque transmission components. This further complicates the structure by requiring passages to be formed through these components to receive the cable. Also, the rotating clutch and force transmission components are likely to rub on the non-rotating cable, potentially causing the sunshade to become jammed or the cable to wear much faster than other components.

U.S. Pat. No. 4,622,987 describes a shade umbrella that can be rotated about a vertical axis. A cam button protrudes through an opening adjacent each end of two annularly mated shaft portions supporting the umbrella. In particular, the button extends through an upwardly extending inner shaft portion and a downwardly extending outer shaft portion. The outer shaft portion abuts a flange coupled with the inner shaft portion to support the inner shaft portion. The cam button is resiliently held in the opening by a torsion spring and is manually depressed by a thumb button that extends to the outside surface of the outer shaft portion. The thumb button can be manually depressed to move the cam button inwardly to release the outer shaft portion, permitting manual rotation of the inner shaft portion and the upper portion of the shade umbrella to control the location of shade provided thereby. After the thumb button is depressed with one hand, a user must take hold of an upper portion of the umbrella with the other hand to provide such rotation.

Two-handed operation is inconvenient. Also, repositioning the umbrella is awkward from any position other than a position on the side of the sunshade where the thumb button is located. Moreover, rotation of the upper pole portion is cumbersome, because there apparently is no limit on the travel of the thumb button. If the thumb button is over-depressed, rotation of the upper pole portion will be prevented. Additionally, such thumb buttons are uncomfortable to use.

SUMMARY OF THE INVENTION

These and other disadvantages of prior rotating umbrellas have created a need for an improved shelter structure and ways to alter the position of such a structure as conditions change. In particular, there is a need for a new umbrella with a canopy that can be flexibly positioned by tilting about a first axis, e.g., a horizontal axis, and by rotating about a second axis, e.g., a vertical axis. In one embodiment, the umbrella should be positionable in a variety of positions and in any vertical plane that extends through a support pole thereof.

In one embodiment, an umbrella is provided that includes a canopy, a support pole, a crank, and a rotation mechanism. The support pole is configured to support the canopy. The support pole includes a lower pole portion and an upper pole portion that has an outer surface. The upper pole portion is rotatably coupled with the lower pole portion. The crank is coupled with the support pole. The crank is configured to open and close the canopy. The rotation mechanism is coupled to the support pole. The rotation mechanism has a hand grip configured to be grasped by a user, a drive gear, and a driven gear. The drive gear is coupled with the hand grip. The driven gear is coupled with the outer surface of the upper pole portion. The drive gear is configured to engage the driven gear whereby a force applied to the hand grip is transmitted to the upper pole portion to turn the canopy.

In some embodiments an umbrella or an umbrella support is provided that has a rotation mechanism that is located at least partially between a portion of a crank, e.g., an axis about which the crank rotates, and a lower portion of a support pole, e.g., a lower end of a support pole.

In another embodiment, an umbrella is provided that includes a lower pole portion, an upper pole portion, a canopy coupled with the upper pole portion, a crank, and a rotation mechanism. The upper pole portion is rotatably coupled with the lower pole portion. The crank is configured to open and close the canopy. The rotation mechanism is configured to apply a force to an outer surface of the upper pole portion.

In another embodiment, an umbrella support is provided that includes a first pole portion, a second pole portion, a crank, and a rotation mechanism. The first pole portion has a first end and a second end. The second pole portion has a first end, a second end, and an outer surface. The first end of the second pole is rotatably coupled with the second end of the first pole portion. The second pole portion extends along a longitudinal axis. The crank is configured to rotate about a crank axis that extends generally transverse to the longitudinal axis. The rotation mechanism is located between the crank axis and the second end of the first pole portion. The rotation mechanism has a first position for rotating the second pole portion and a second position.

In some embodiments, an umbrella or an umbrella support comprises a rotation mechanism that is configured to apply a force to an outer or an external surface of a support pole. For example, the rotation mechanism can include a sleeve with a hand grip that transmits a force applied thereto to the outer or external surface of the support pole.

In another embodiment, a method is provided for sheltering an area from ambient weather conditions. The method includes providing an umbrella having a lower pole portion, an upper pole portion, a canopy, a crank, and a rotation mechanism. The rotation mechanism has a hand grip. The method also includes moving the hand grip to a canopy rotation position and applying a force to the hand grip while the hand grip is in the canopy rotation position. The method also includes configuring the rotation mechanism such that the force applied to the hand grip is transmitted from the hand grip to the upper pole portion.

In another embodiment, an umbrella support is provided that comprises a canopy frame, a support pole, and a rotation mechanism. The support pole is coupled with the canopy frame and has an external surface. The support pole includes a tiltable pole portion coupled with the canopy frame, an upper pole portion, and a lower pole portion. The upper pole portion at least partially defines the external surface of the support pole. The upper pole portion extends along a longitudinal axis. The upper pole portion is coupled with the tiltable pole portion such that the tiltable pole portion is able to tilt about an axis that is generally perpendicular to the longitudinal axis. The rotation mechanism is located at least partially between the upper pole portion and lower pole portion and is configured to rotate the upper pole portion.

In some embodiments, an umbrella or umbrella support is provided that is able to provide rotation of an upper portion about a longitudinal axis thereof relative to a lower portion through a range of about three-hundred and sixty degrees.

In some embodiments an umbrella or umbrella support is provided that comprises a support pole and a sleeve that includes a hand grip. The sleeve is coupled with the support pole in a manner that permits the sleeve to translate along the support pole to engage or disengage members that transmit to a surface (e.g., an external surface) of the support pole a force applied to the hand grip.

Thus, one embodiment of the invention provides an umbrella where the entire umbrella above the crank or crank housing is rotatable, preferably through 360°. Consequently, the upper pole extending above the crank or crank housing and the canopy supported by that pole is rotatable together by means of a rotation mechanism. This mechanism preferably comprises means, located below the transverse axis of the crank or substantially below the crank housing, that is rotatable by a user to cause corresponding rotation in the umbrella, relative to the ground.

Some preferred embodiments of the invention are described below with reference to the accompanying drawings.

DETAILED DESCRIPTION OF THE PREFERRED EMBODIMENT

Figure 1:
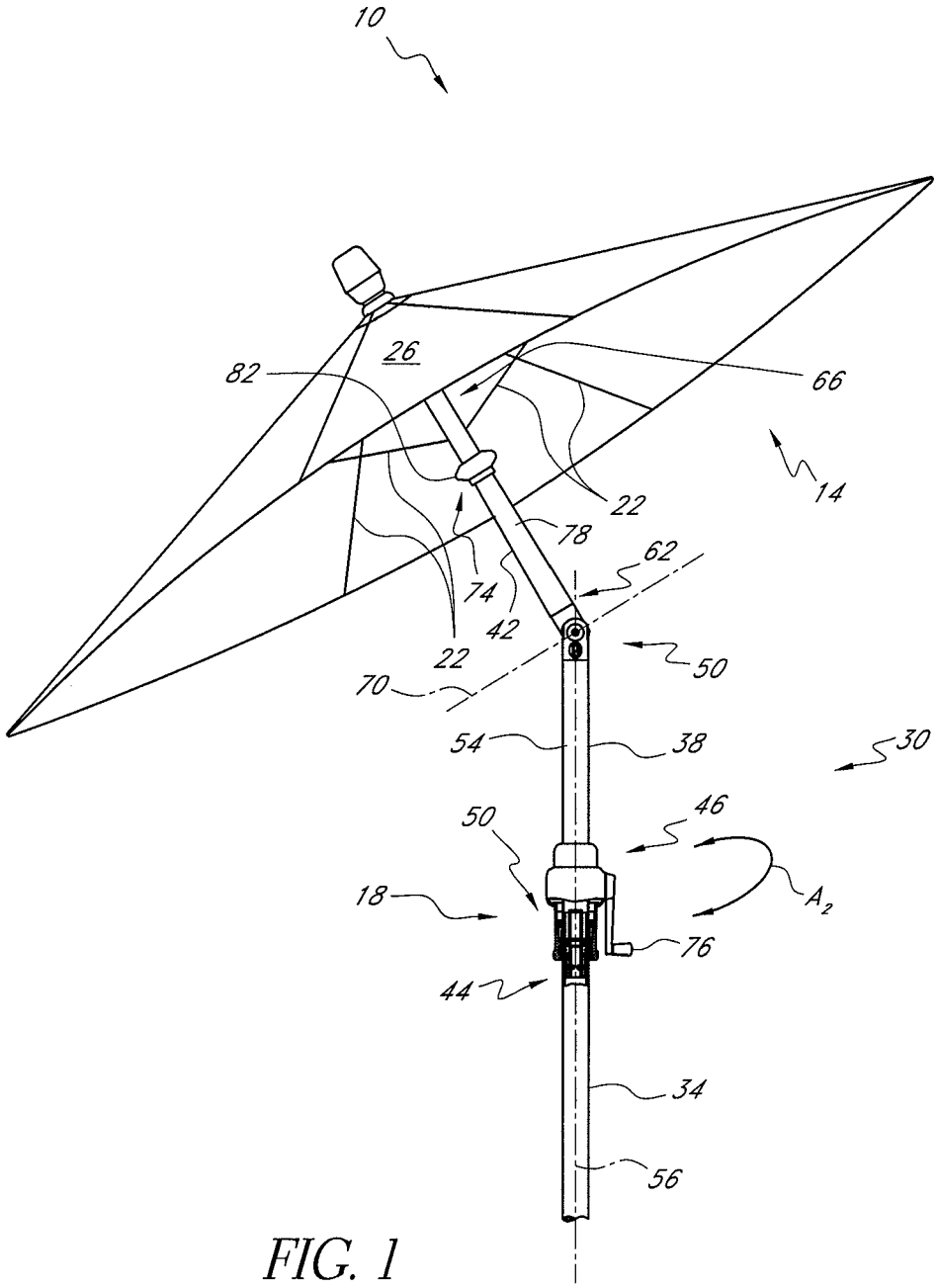
FIG. 1 is a plan view of one embodiment of an umbrella that has a rotation mechanism.

FIG. 1 is a plan view of one embodiment of an umbrella 10 that has a canopy 14 and a rotation mechanism 18. As discussed more fully below, the rotation mechanism 18 advantageously is arranged to transmit a torque directly to a first portion of the umbrella 10 relative to a second portion thereof to impart relative motion therebetween, e.g., rotation of an upper portion relative to a lower portion. Additionally, the rotation mechanism 18 advantageously is located beneath a second mechanism that opens and closes the canopy 14. As discussed further below, the second mechanism can be one that is driven by a crank. These and other features discussed below provide a simple structure compared to prior designs and provide flexible positioning at any desired tilt angle within a large number of vertical planes extending through the umbrella 10.

The canopy 14 can take any suitable or conventional form. In one embodiment, the canopy 14 includes a frame 21 comprising a plurality of ribs 22 and a cover 26 that extends over the frame 21 and ribs 22. Preferably, the cover 26 is coupled with the ribs 22. Preferably, the frame 21 can be moved from a closed configuration to one or more open configurations. FIG. 1 shows an open configuration. In the closed configuration, the cover 26 can be loosely draped over the frame 21. In the open configuration, the cover 26 usually is taut, which here means tightly drawn or without slack. In the open configuration, the frame 21 applies a tension force to the cover 26. Although not illustrated here, the canopy 14 can also include a conventional vent structure that reduces the effect of gusts of wind on the umbrella 10. The canopy 14 is a conventional umbrella canopy in some embodiments.

Preferably the umbrella 10 also includes a support pole 30 configured to support the canopy 14. In one embodiment, the support pole 30 has a lower pole portion 34, an upper pole portion 38, and a tiltable pole portion 42. The lower pole portion 34 extends from a lower end (not shown) to an upper end 44. The lower pole portion 34 can be a fixed pole portion, e.g., if coupled with a fixed base or with the ground. The upper pole portion 38 can be a rotatable pole portion that extends along a rotatable pole longitudinal axis. The upper pole portion 38 has a lower end 46, an upper end 50, and an outer surface 54. The upper pole portion 38 preferably is rotatably coupled with the lower pole portion 34. In one embodiment, a longitudinal axis 56 extends through the lower pole portion 34 and the upper pole portion 38. The longitudinal axis 56 can correspond to the rotatable pole longitudinal axis. The upper pole portion 38 can be configured to rotate about the longitudinal axis 56 relative to the lower pole portion 34. The upper pole portion 38 is capable of rotating about the longitudinal axis 56 relative to the lower pole portion 34 in some embodiments. Preferably that rotation is through 360°. The upper pole portion 38 can be rotatably coupled with the lower pole portion, e.g., by the rotation mechanism 18 discussed in greater detail below in connection with FIGS. 2-5.

The tiltable pole portion 42 can take any suitable or conventional form. In one embodiment, the tiltable pole portion 42 has a lower end 62 and an upper end 66. The upper end 66 can be coupled with the canopy 14. The lower end 62 can be coupled with the upper end 50 of the upper pole portion 38 in a manner that permits the tiltable pole portion 42 to rotate about a tilt axis 70. The coupling of the tiltable pole portion 42 and the upper pole portion 38 at the tilt axis 70 is sometimes referred to herein as a joint. The tilt axis 70 is generally perpendicular to the longitudinal axis 56 in some embodiments.

Figure 2:
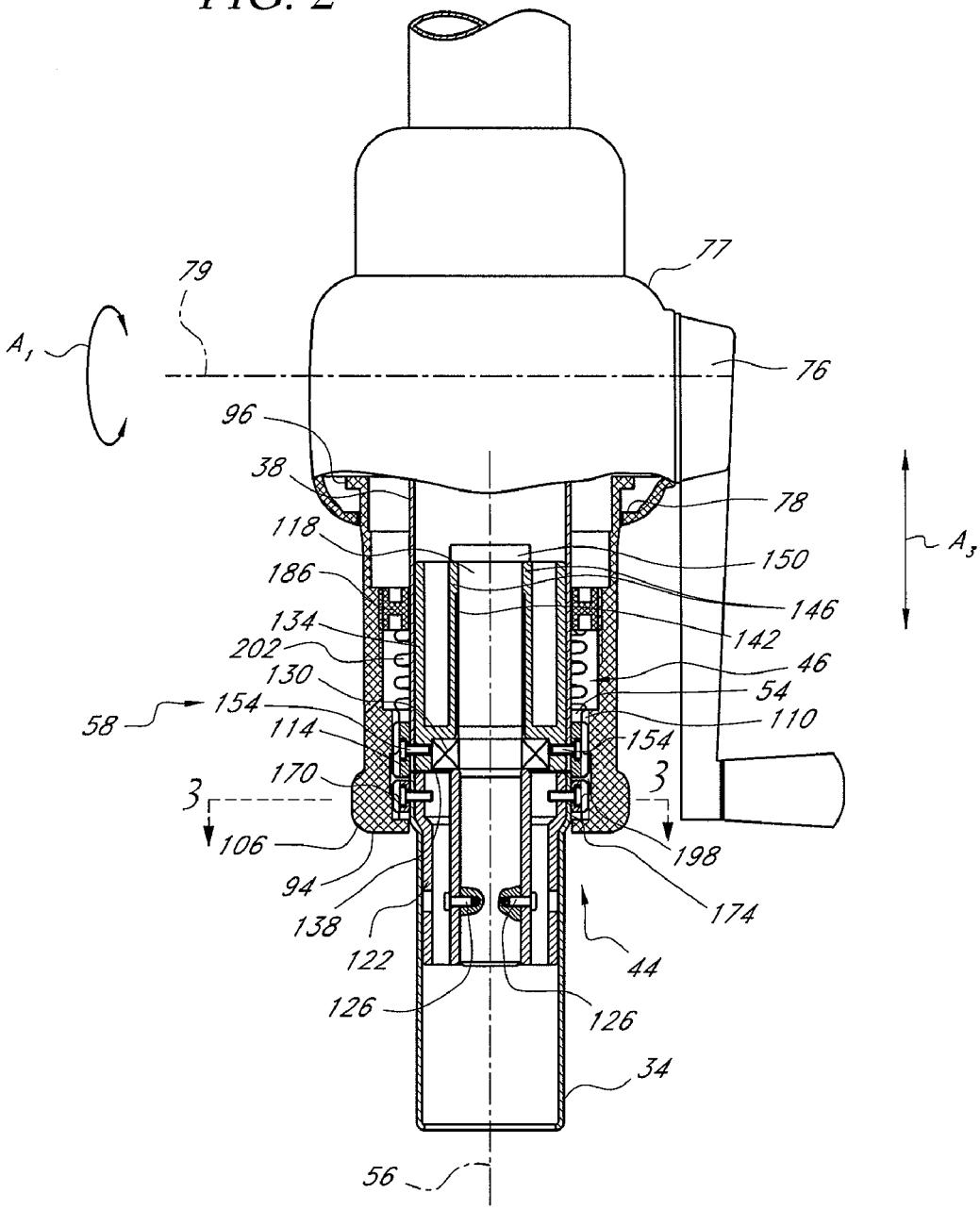
FIG. 2 is a partial section view of one embodiment of a rotation mechanism for an umbrella, with the rotation mechanism shown in a first position.
Figure 3:
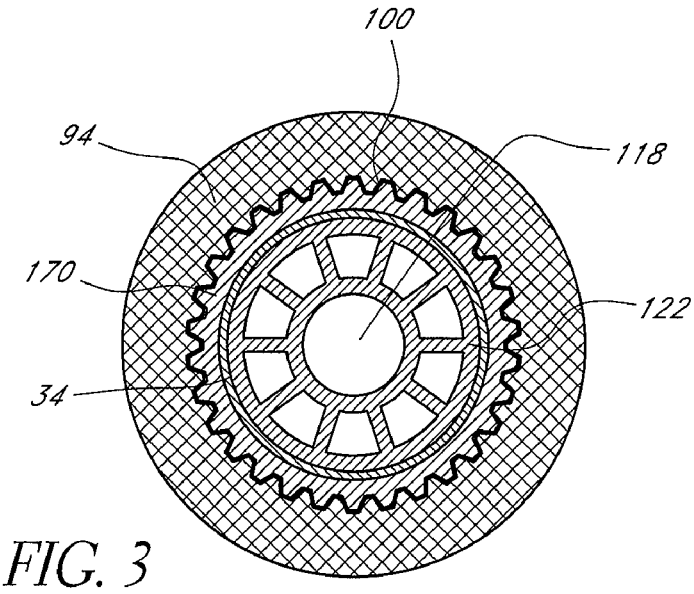
FIG. 3 is cross-section view of the rotation mechanism of FIG. 2 when the rotation mechanism is in the first position, the section being taken along the section plane 3-3.

Any suitable or conventional tilting mechanism can be used. For example, the tiltable pole portion 42 can be tilted by a crank 76, as further described below. Crank mechanisms are advantageous for opening and closing the canopy 14 and for tilting the tiltable pole portion 42 because the crank 76 generates sufficient mechanical advantage to overcome the weight of the canopy 14 and any other forces or pressures applied to the canopy 14, e.g., lift or other pressures generated by wind. The crank 76 preferably is configured to rotate about a crank axis 79 extending transverse to the longitudinal axis 56. Such rotation is illustrated in FIG. 2 by double headed arrow $A_1$.

In one embodiment, the crank 76 is mounted in a housing 77 in a manner that permits the crank 76 to rotate therein. In one embodiment, the housing 77 includes an edge or stop 78 that is configured to limit the travel of a portion of the rotation mechanism 18.

In one embodiment, a canopy deployment mechanism 74 is coupled with an outer surface 78 of the tiltable pole portion 42. In one embodiment, the canopy deployment mechanism 74 includes a sleeve 82 that at least partially surrounds the tiltable pole portion 42 and that is configured to slide along the tiltable pole portion 42 to move the frame 21 of the canopy 14. By moving the sleeve 82 toward the upper end 66 of the tiltable pole portion 42 the frame 21 and the cover 26 of the canopy 14 are moved to the open configuration. By moving the sleeve 82 toward the lower end 62 of the tiltable pole portion 42 the frame 21 and the cover 26 of the canopy 14 are moved to the closed configuration. Although the illustrated embodiment includes a sleeve 82 for moving the canopy 14 between an open and a closed configuration, other mechanisms can be used. For example, a canopy deployment mechanism that is configured to or capable of being operated by a crank can be used in some embodiments.

As discussed above, the crank 76 can be used to tilt the tiltable pole portion 42 relative to the upper pole portion 38. Any suitable mechanism, linkage, or combinations of mechanical structures can interconnect the crank 76 and the tiltable pole portion 42. For example, a tension member (not shown) can be threaded through an internal passage in the upper pole portion 38 between the crank 76 and the tilt axis 70. In one embodiment a tension member such as a cord, a chain, or a cable is wound around a first spool or drum (not shown) coupled with the crank 76 and is wound around a second spool or drum (not shown) located at the tilt axis 70 and coupled with the tiltable pole portion 42. Rotation of the crank 76 induces a force in the tension member which is transmitted to the second spool or drum and to the tiltable pole portion 42 to tilt the canopy 14. In one embodiment, the crank 76 is configured to open and close the canopy 14 (e.g., by moving the sleeve 82) and to move the tiltable pole portion 42 to tilt the canopy 14. The crank mechanism can be conventional in other aspects.

In one variation, the crank 76 is configured to open and close the canopy 14 rather than to tilt the tiltable pole portion 42.

FIGS. 2-5 illustrate one embodiment of the rotation mechanism 18. The rotation mechanism 18 is coupled to the support pole 30. In the illustrated embodiment, the rotation mechanism 18 is at least partially located between the crank 76 and the lower pole portion 34. The rotation mechanism 18 can be located at an elevation below the crank 76. In some embodiments, the rotation mechanism 18 is located between a spool coupled with the crank 76 and an end of the lower pole portion 34 that is opposite the canopy 14, e.g., in a vertically mountable umbrella, below or at an elevation below the spool. As discussed above, the rotation mechanism 18 enables the upper pole portion 38 to move, e.g., to be rotated, relative to the lower pole portion 34. In one embodiment, the umbrella 10 is configured such that when the upper pole portion 38 is rotated, the crank 76 is rotated with the upper pole portion 38. Such rotation is illustrated in FIG. 1 by double headed arrow $A_2$. In one embodiment, as discussed further below, the rotation mechanism 18 is configured to apply a force to the upper pole portion 34.

Locating the rotation mechanism 18 below the crank 76 provides several advantages. For example, the structure is greatly simplified. In particular, the components corresponding to the crank 76 do not need to be threaded through the components of the rotation mechanism 18. This reduces the chance for wear of these components and reduces the likelihood that the umbrella 10 will become jammed. Additionally, this construction enables the crank 76 to be rotated with an upper portion of the umbrella 10, which enables the crank 76 to be operated from any position by simply rotating it about the vertical axis.

The operation of the rotation mechanism 18 has other advantages. For example, the rotation mechanism 18 has smooth operation due to the presence of a bearing between structured connected to the upper pole portion 38 and structure connected to the lower pole portion 34. Other advantages of the rotation mechanism 18 are discussed below.

In one embodiment, the rotation mechanism includes a hand grip 94 that is configured to be grasped by a user and a transmission device 98 located between the hand grip 94 and the support pole 30. The hand grip 94 can take the form of a sleeve, which preferably has a generally cylindrical shape. Thus, hand grip 94 preferably comprises an inner passage surrounded by an inner surface 100 having an inner perimeter greater than the outer perimeter of at least one of the upper pole portion 38 and the lower pole portion 34. In one embodiment, the hand grip 94 extends into the housing 77 containing the crank 76 and fully surrounds a portion of the support pole 30, e.g., fully surrounds the upper end 44 of the lower pole portion 34 and the lower end 46 of the upper pole portion 38. The hand grip also includes a flange 96 that cooperates with the housing 77 in a manner described below to limit the travel of the hand grip 94. The hand grip 94 can include a ridge 106 that is configured to support a portion of a hand gripping the hand grip 94 making the hand grip 94 easier to grip. In one embodiment, the ridge 106 fully surrounds a portion of the support pole 30. The ridge. 106 is one form of a grip enhancer that may be used in connection with the hand grip 94. Other grip enhancers may include a knurled or roughened outer surface or a modification of an outer surface, e.g., the application of a gripable material such as a non-slip material, or other modification to make the hand grip 94 easier to manipulate.

In one embodiment, the transmission device 98 includes a drive member. 110 and a driven member 114. The drive member 110 can include any suitable drive member, such as one or more ridges or a plurality of teeth, which can form a part of a gear. Preferably, the drive member 110 is coupled with the hand grip 94. In one embodiment, the drive member 110 is formed on the inner surface 100 of the hand grip 94. For example, the drive member 110 can include a plurality of gear teeth formed on the inner surface 100 of the hand grip 94. The drive member 110 can include a gear coupled with the inner surface 100 of the hand grip 94, e.g., by a press fit or an interference fit.

The driven member 114 also can include any suitable driven member, such as one or more ridges or a plurality of teeth, which can form a part of a gear. Preferably, the driven member 114 is coupled with the support pole 30. In one embodiment, the driven member 114 is coupled with the lower end 46 of the upper pole portion 38. In one embodiment, the driven member 114 is formed on or mounted to the outer surface 54 of the upper pole portion 38. For example, the driven member 114 can include a plurality of gear teeth formed on or mounted to the outer surface 54 of the upper pole portion 38. The driven member 114 can include a gear coupled with the upper pole portion 38, e.g., by a press fit or an interference fit.

As discussed above, the upper pole portion 38 preferably is rotatably coupled with the lower pole portion 34. Any suitable rotation mechanism or coupling can be provided. In one embodiment, a least a portion of the upper and lower pole portions 38, 34 include a hollow portion. Structures to rotatably couple the upper and lower pole portions 38, 34 are housed in the hollow portion. For example, a shaft 118 can be provided that extends into a hollow portion of each of the upper and lower pole portions 38, 34. The shaft 118 can be mounted in a shaft housing 122. In the illustrated embodiment, the shaft housing 122 is mounted in a hollow portion of the lower pole portion 34. In particular, fasteners 126, such as bolts, screws, or pins, can be provided to fix the shaft 118 in the shaft housing 122. Also, fasteners 126, such as bolts, screws, or pins, can be used to mount the shaft housing 122 in the hollow portion of the lower pole portion 34.

The upper pole portion 38 is rotatably journaled with the lower pole portion 34 by way of the shaft 118. In on one embodiment, a bearing 130 is mounted (e.g., coupled with a fastener or press or interference fit) on the shaft 118. A cylindrical member 134 can be positioned between the upper pole portion 38 and the bearing 130 and can be coupled with the bearing 130. The bearing 130 enables the cylindrical member 134 to rotate relative to the shaft 118. The cylindrical member 134, the bearing 130, and the adjacent portion of the shaft 118 can be housed within a hollow portion of the upper pole portion 38.

In the illustrated embodiment, the cylindrical member 134 has a shoulder 138 that rests on an upper surface of the bearing 130. A gap 142 is formed between the cylindrical member 134 and the shaft 118 for a substantial portion of the length of the cylindrical member 134. In one embodiment, the cylindrical member 134 extends substantially the entire length of the shaft 118 that is inside the upper pole portion 38. In one embodiment, an inner surface 146 of the cylindrical member 134 contacts a portion of the shaft 118. The construction including the bearing 130 is advantageous over prior designs that provide only an abutment between a rotating pole portion and a non-rotating pole portion. In particular, this construction provides a smoother rotation so that a much lower amount of force is needed to rotate an upper portion relative to a lower portion than is required with a comparatively high-friction abutment-type construction. These features, which lessen the force needed for operation of the rotation mechanism 18, facilitate one-handed operation which is not possible with some prior designs. One-handed operation is operation where a user can cause an upper pole portion to rotate relative to a longitudinal axis thereof (or relative to a lower pole portion) without needing to use two hands. Lessening the force needed for rotation has additional advantages for users who are not as strong, e.g., the elderly or disabled.

In one embodiment, a cap 150 is provided to prevent the cylindrical member 134 from moving relative to the shaft 118 along the longitudinal axis 56. Among other advantages, the cap 150 prevents the upper portion of the umbrella 10 from being detached from the lower portion, limiting theft and vandalism when the umbrella 10 is deployed in a public place.

Preferably the cylindrical member 134 is fixed to the upper pole portion 38. Any suitable arrangement can be employed to fix the cylindrical member 134 to the upper pole portion 38. For example, the cylindrical member 134 can be press fit or interference fit into the upper pole portion 38. In one embodiment, a fastener 154 (e.g., a screw, pin, or bolt) can be used to connect the upper pole portion 38 to the cylindrical member 134. In one embodiment, the driven member 114 also is coupled to the upper pole portion 38 by the fastener 154.

Figure 4:
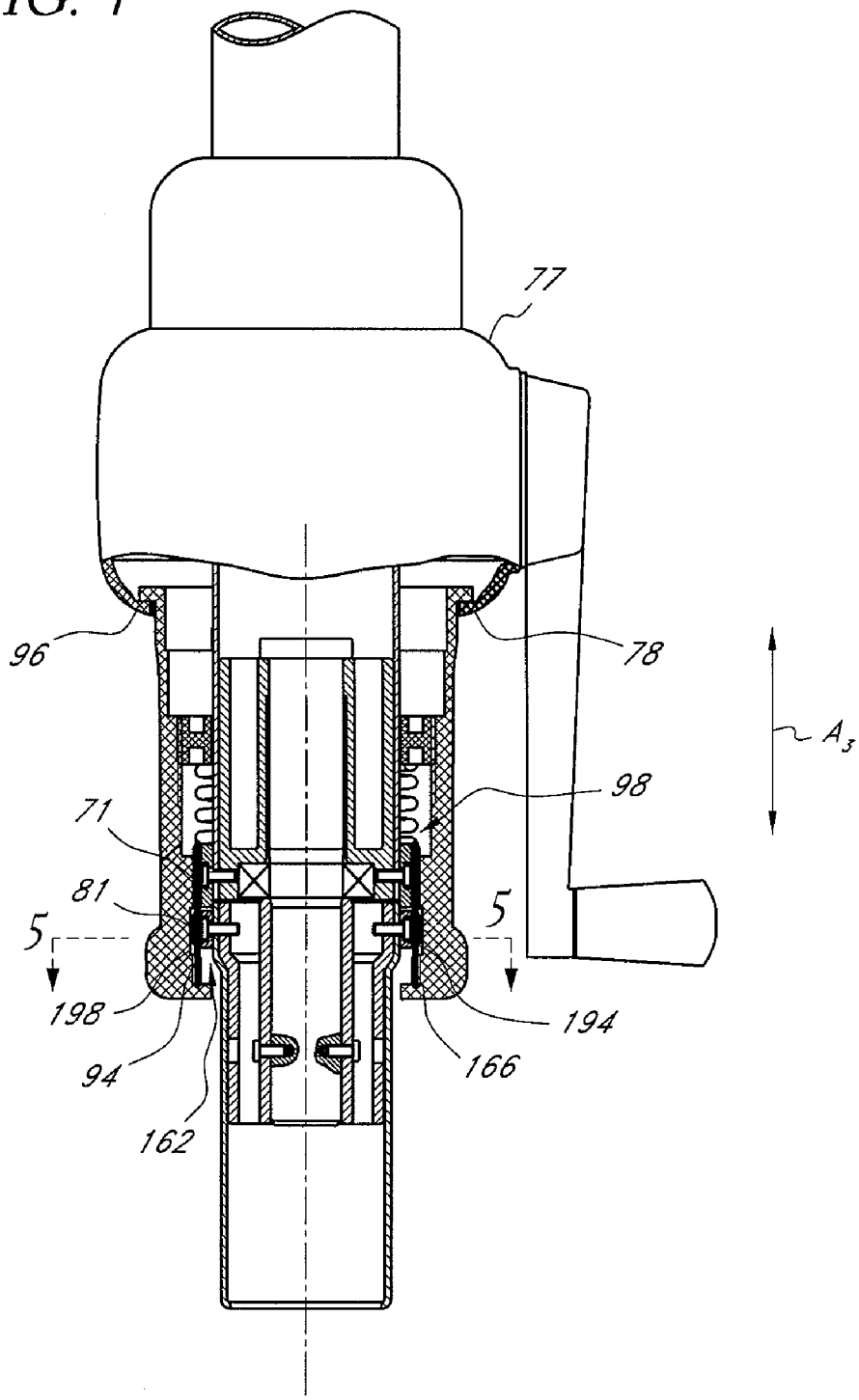
FIG. 4 is a partial section view of the rotation mechanism of FIG. 2 shown in a second position.

In one embodiment, the hand grip 94 of the umbrella 10 is moveable between at least two positions. For example, in the illustrated embodiment, the hand grip 94 is movable between a first position (FIG. 2) and a second position (FIG. 4). Such movement is illustrated by double-headed arrow $A_3$ in FIGS. 2 and 4. When the hand grip 94 is in the second position, the drive member 110 and driven member 114 are substantially aligned. "Substantially aligned" here means that a portion of the drive member 110 (e.g., teeth of a drive gear) engage a portion of the driven member 114 (e.g., teeth of a driven member) when a force is applied to the hand grip 94. The drive and driven member 110, 114 are also substantially aligned in the first position in the illustrated embodiment. As discussed above, some embodiments have an arrangement that limits the travel of the hand grip 94. In one embodiment, the edge 78 of the housing 77 is configured to engage the hand grip 94, e.g., to engage the flange 96 of the hand grip, to limit travel thereof. More particularly, the flange can have an outer perimeter that is greater in length than the inner perimeter of the edge 78 of the housing 77. Thus, when the hand grip 94 is moved to the position shown in FIG. 4, contact is made between the flange 96 and the edge 78, which contact prevents further downward movement of the hand grip 94. Such a limit on travel is advantageous in some embodiments in that it prevents over-compression of a spring (discussed below) that biases the hand grip 94 in the position of FIG. 2. Additionally, the limit on travel can provide a clear tactile signal that the rotation mechanism 18 is in a rotation position, as discussed more fully below.

In the illustrated embodiment, a locking or clutch mechanism 162 is provided that selectively enables or prevents the drive member 110 from engaging the driven member 114 to rotate a portion of the support pole 30 about the longitudinal axis 56. When the clutch mechanism 162 is not actuated, the drive and driven members 110, 114 are prevented from moving. One embodiment of the clutch mechanism 162 includes a first clutch member 166 coupled with the hand grip 94 and a second clutch member 170 coupled with the lower pole portion 34. The first and second clutch members 166, 170 are gears in one embodiment.

The clutch mechanism 162 is capable of being in effect or engaged in one of the first and second positions and being disengaged in the other of the first and second positions hereinabove described. In particular, the first clutch member 166 can include a gear located on an inner surface of the hand grip 94 and the second clutch member 170 comprises a gear located on an outer surface 174 of the lower pole portion 34. When the hand grip 94 is in the position illustrated in FIG. 2, the gears of the first and second clutch members 166, 170 are engaged. The second clutch member 170 is prevented from moving relative to the lower pole portion 34 by being connected to the lower pole portion 34 by a fastener. Because the second clutch member 170 is prevented from moving relative to the lower pole portion 34, the first clutch member 166 also is prevented from moving relative to the lower pole portion 34. The first clutch member 166 is fastened to (or formed as a part of) the hand grip 94 and, therefore, the hand grip 94 also is prevented from rotating relative to the lower pole portion 34.

In the first position, the drive and driven member 110, 114 are engaged and therefore the driven gear 114 is prevented from moving. In the illustrated embodiment, the driven gear 114 is connected to the upper pole portion 38 and so the upper pole portion 38 is prevented from moving relative to the lower pole portion 34. In the first position, rotation of the upper pole portion 38 relative to the lower pole portion 34 is substantially prevented by the clutch mechanism 162.

The clutch mechanism 162 can also be actuated engaged by moving the hand grip 94 to one of the first and second positions hereinbefore described. In particular, in the illustrated embodiment, the clutch mechanism 162 is engaged, enabling rotation, when configured as in FIG. 4 and is disengaged preventing movement when configured as shown in FIG. 2.

As discussed above, some embodiments enable the clutch mechanism 162 to move between multiple positions, e.g., enabling engagement and disengagement of the clutch mechanism 162. The illustrated embodiment has additional features making engagement and disengagement more convenient. For example, a bearing 186 may be positioned between the hand grip 94 and a portion of the support pole 30 to enable the hand grip 94 to be moved between the first of FIG. 2 and the second position of FIG. 4. The bearing 186 preferably is coupled with the inner surface 100 of the hand grip 94 so that as the hand grip 94 is moved along the support pole 30, the bearing 186 also moves. In one embodiment, the bearing 186 has a low friction engagement portion that faces the outer surface 54 of the upper pole portion 48. The low friction engagement portion can be a low friction material or a ball or roller bearing, for example.

The first and second clutch members 166, 170 may also be configured to facilitate the movement of the hand grip 94 between the first and second position. For example, the first clutch member 166 can be provided with a first tapered edge 194 and the second clutch member 170 can be provided with a second tapered edge 198. In one embodiment, the first and second tapered edges 194, 198 are configured to align the first and second clutch members 166, 170 as the rotation mechanism is being moved between the first and second positions, e.g., from the second position (clutch engaged) to the first position (clutch disengaged).

The clutch mechanism 162 can be made even more convenient by biasing the hand grip 94 to one of the first and second positions. Preferably the hand grip 94 is biased to the first position of FIG. 2, wherein the clutch is disengaged. In this position, rotation of the upper pole portion 38 (and, therefore, the canopy 14) is prevented, as discussed above. In one embodiment, the biasing is provided by a spring 202 that is located between the bearing 186 and a structure coupled with the upper pole portion 38. Of course, the spring 202 can be replaced by any suitable resilient member. In the illustrated embodiment, the spring 202 extends between the bearing 186 and an upper surface of the driven member 114. The spring 202 is compressed when the hand grip 94 is in the second position and is expanded when the hand grip 94 is in the first position.

The foregoing structure can be used in a method of sheltering an area from ambient weather conditions. The umbrella 10 is provided in the method with the lower pole portion 34, the upper pole portion 38, the canopy 14. The umbrella also includes the crank 76 for opening and closing the canopy. The umbrella also includes the rotation mechanism 18. The rotation mechanism 18 is located between the crank 76 and the lower pole portion 34. In one method the rotation mechanism includes a clutch mechanism 162. The clutch mechanism 162 can include the hand grip 94.

In one technique, the hand grip 94 is moved to a canopy rotation position. Any suitable technique can be provided for moving the hand grip 94 to the canopy rotation position. For example, the hand grip 94 can be translated along the upper pole portion 38. The bearing 186 can enable a downward force applied to the hand grip 94 to result in a downward motion of the hand grip 94 relative to the support pole 30. The ridge 106 or other grip enhancer can make gripping the hand grip 94 easier, especially for individuals with less hand strength.

Figure 5:
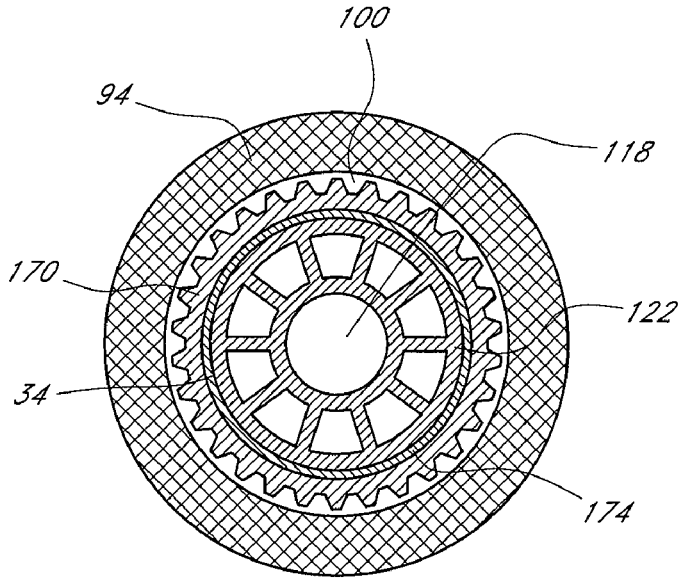
FIG. 5 is cross-section view of the rotation mechanism of FIG. 2 when the rotation mechanism is in the second position, the section being taken along the section plane 5-5 shown in FIG. 4.

The canopy rotation position may correspond to the position shown in FIGS. 4 and 5. FIG. 5 shows the relationship of the second clutch member 170 and the hand grip 94. In particular, in the canopy rotation position, the second clutch member 170 is spaced from the hand grip 94. More particularly, the second clutch member 170 does not contact the first clutch member 166. This condition is sometimes referred to herein as having the clutch mechanism engaged. In this position, the second clutch member 170 is free to rotate with the passage defined inside the hand grip 94.

With the hand grip 94 in the canopy rotation position, a force can be applied to the hand grip 94 to cause the hand grip to rotate about the support pole 30. The rotation mechanism 18 is configured, in one technique, such that the force applied to the hand grip 94 is transmitted from the hand grip to the upper pole portion 34. The rotation mechanism 18 can be so configured by providing mating drive and driven members as discussed above, e.g., drive and driven gears. One advantage provided by this structure and technique is that the force applied to the hand grip 94 is transmitted to directly to the upper pole portion, e.g., at the same elevation as the hand grip 94, rather than requiring an elongated force transmission member that extends a substantial distance up from the hand grip 94. This construction provides smoother operation, more immediate response, and eliminates components subject to wear, such as an elongated force transmission member.

As discussed above, another convenient technique biases the hand grip 94 to a locked or clutch disengaged position. A locked position is one in which unwanted rotation of the canopy 14 or of the upper pole portion 38 about the longitudinal axis 56 is substantially prevented. Substantially prevented means in this context that the rotation of the upper pole portion 38 relative to the lower pole portion 34 is limited to the play or tolerances of one or more components of the rotation mechanism 18.

Preferably the rotation mechanism 18 or the hand grip 94 is biased so that when the clutch mechanism 162 is in a free state, the first and second clutch members 166, 170 are meshed together. In one technique, the rotation mechanism 18 is configured so that movement of the hand grip 94 to the canopy rotation position compresses the spring 202 or other resilient member. In one technique, the hand grip 94 is biased such that after the hand grip 94 is released, the spring 202 applies a force to the hand grip 94 causing the hand grip 94 to return to the locked or clutch disengaged position.

Another advantageous technique involves configuring the drive member with a first alignment feature and a driven member with a second alignment feature. The first and second alignment features may be alignment edges or surfaces. In one technique, the first and second alignment features are configured to rotate the hand grip 94 about the upper pole portion 38 a small amount to enable the hand grip 94 to return to the locked position. For example, the alignment features may rotate the hand grip about the axis 56 an amount about equal to one gear tooth, less than one gear tooth, one-half of one gear tooth, or a small fraction of a gear tooth, e.g., less than one-half of a gear tooth.

The foregoing techniques can be combined with additional techniques for positioning and configuring the umbrella 10. For example, the crank 76 can be coupled with a mechanism configured to respond to movement of the crank 76 by opening or closing the canopy. Alternatively, the crank 76 can be coupled with a mechanism configured to respond to movement of the crank 76 by tilting the tiltable pole portion 42 about the tilt axis 70.

Some conventional umbrellas also combine other mechanisms with such a crank driven tilting mechanism to provide other functions, e.g., to open and close the canopy. However, providing multiple mechanisms results in an overly complex and expensive structure that tends to wear out and break.

What is claimed is:

1. An umbrella comprising:

a canopy;

a support pole configured to support the canopy, the support pole comprising:

a lower pole portion; and an upper pole portion comprising an outer surface, the upper pole portion being rotatably coupled with the lower pole portion;

a crank coupled with the support pole, the crank being configured to open and close the canopy; and a rotation mechanism coupled to the support pole, the rotation mechanism comprising:

a hand grip being rotatably coupled to the outer surface of the upper pole portion, and being configured to be grasped by a user;

a drive gear coupled with the hand grip;

a driven gear coupled with the outer surface of the upper pole portion, the drive gear being configured to engage the driven gear whereby a force applied to the hand grip is transmitted to the upper pole portion to rotate the upper pole portion and the canopy.

2. The umbrella of claim 1, wherein the hand grip and the drive gear substantially surround a portion of the upper pole portion.

3. The umbrella of claim 1, wherein the hand grip is moveable between a first position and a second position, and wherein when the hand grip is in the second position, the drive and driven gears are engaged.

4. The umbrella of claim 3, wherein when the hand grip is in the first position the drive and driven gears are disengaged.

5. The umbrella of claim 4, wherein when the hand grip is in the first position, a locking mechanism is engaged to substantially prevent rotation of the upper pole portion relative to the lower pole portion.

6. The umbrella of claim 5, wherein the locking mechanism comprises a first locking gear coupled with the hand grip and a second locking gear coupled with the lower pole portion.

7. The umbrella of claim 3, wherein the hand grip is biased to the first position.

8. The umbrella of claim 1, further comprising a locking mechanism engageable to substantially prevent rotation of the upper pole portion relative to the lower pole portion.

9. The umbrella of claim 8, wherein the locking mechanism comprises a first member coupled with the hand grip and a second member coupled with the lower pole portion, the first and second portions being selectively engageable.

10. The umbrella of claim 9, wherein the first member comprises a first locking gear and the second member comprises a second locking gear that is configured to engage the first locking gear.

11. The umbrella of claim 1, wherein the crank is rotatable about a crank axis, the rotation mechanism being located at least partially between the crank axis and the lower pole portion.

12. The umbrella of claim 1, wherein the rotation mechanism is configured to rotate the crank about a longitudinal axis of the support pole when the canopy is turned.

13. An umbrella comprising:

a canopy:

a support pole configured to support the canopy, the support pole comprising:

a lower pole portion; and an upper pole portion comprising an outer surface, the upper pole portion being rotatably coupled with the lower pole portion;

a crank coupled with the support pole, the crank being configured to open and close the canopy; and a rotation mechanism coupled to the support pole, the rotation mechanism comprising:

a hand grip being rotatably coupled to the outer surface of the upper pole portion, and being configured to be grasped by a user;

a drive gear coupled with the hand grip;

a driven gear coupled with the outer surface of the upper pole portion, the drive gear being configured to engage the driven gear whereby a force applied to the hand grip is transmitted to the upper pole portion to rotate the upper pole portion and the canopy;

wherein the hand grip is moveable between a first position and a second position, and wherein when the hand grip is in the second position, the drive and driven gears are engaged wherein when the hand grip is in the first position the drive and driven gears are disengaged wherein when the hand grip is in the first position, a locking mechanism is engaged to substantially prevent rotation of the upper pole portion relative to the lower pole portion wherein the locking mechanism comprises a first locking gear and a second locking gear, the first locking gear comprising a first tapered edge and the second locking gear comprising a second tapered edge, the first and second tapered edges configured to align the first and second locking gears while the rotation mechanism is being moved to the first position.

14. An umbrella support comprising:

a lower pole portion extending along a longitudinal axis;

an upper pole portion at least partially extending along said longitudinal axis and having an outer surface and being rotatably coupled with the lower pole portion; and a rotation mechanism including a transmission having a driven member coupled with the upper pole portion and a drive member coupled with a hand grip such that a force applied to the hand grip is transmitted through the drive and driven members to the upper pole portion, and said rotation mechanism having a first configuration wherein a force can be transmitted to the outer surface of the upper pole portion to cause rotation of the upper pole portion and a second configuration wherein rotation of the upper pole portion is prevented, the first configuration being displaced from the second configuration along said longitudinal axis.

15. The umbrella support of claim 14, further comprising a crank rotatable about a crank axis, the rotation mechanism being located at least partially between the crank axis and the lower pole portion.

16. The umbrella support of claim 15, wherein the crank is rotatable about said longitudinal axis.

17. The umbrella support of claim 14, wherein the rotation mechanism at least partially surrounds a lower portion of the upper pole portion.

18. The umbrella support of claim 14, wherein the driven member comprises a gear.

19. The umbrella support of claim 14, wherein the drive member comprises a plurality of gear teeth formed on an inner surface of the hand grip.

20. The umbrella support of claim 19, wherein the driven member comprises a gear.

21. The umbrella support of claim 14, wherein the rotation mechanism comprises said hand grip is movable between a first position and a second position, the second position enabling a force to be transmitted to the upper pole portion to cause the upper pole portion and the canopy to rotate.

22. The umbrella support of claim 21, wherein when the hand grip is in the first position, a force applied to the canopy is transmitted through the upper pole portion to a fixed member whereby rotation of the canopy is prevented.

23. The umbrella support of claim 21, wherein the rotation mechanism further comprises means for returning the hand grip to the first position.

24. The umbrella support of claim 21, wherein the rotation mechanism further comprises a spring for returning the hand grip to the first position.

25. The umbrella support of claim 21, wherein the hand grip is movable relative to the upper pole portion between the first and second positions.

26. The umbrella support of claim 14, wherein the rotation mechanism is configured to apply a force to the outer surface of the upper pole portion at an elevation below the crank.

27. An umbrella comprising:

the umbrella support of claim 14;

a canopy coupled with the upper pole portion; and a crank configured to open and close the canopy.

28. The umbrella of claim 27, wherein the rotation mechanism further comprises:

the hand grip configured to be grasped by a user;

the drive member being a drive gear coupled with an inner surface of the hand grip;

a the driven member being driven gear coupled with the outer surface of the upper pole portion, the drive gear being configured to engage the driven gear, whereby a force applied to the hand grip is transmitted to the upper pole portion to turn the canopy;

a first rotation prevention gear coupled with the inner surface of the hand grip;

a second rotation prevention gear coupled with an outer surface of the lower pole portion, the second rotation prevention gear being configured to engage the first rotation prevention gear, whereby the upper pole portion is prevented from rotating; and a spring at least partially surrounding the upper pole portion;

wherein the hand grip is configured to be displaced along a longitudinal axis of the umbrella support such that the drive and driven gears engage, and wherein said spring biases said hand grip so that the first and second rotation prevention gears engage.

29. An umbrella support comprising:

a lower pole portion;

an upper pole portion having an outer surface and being rotatably coupled with the lower pole portion;

a rotation mechanism comprising a hand grip having an outer surface said hand grid being coupled to the outer surface of the upper pole portion, said rotation mechanism having a clutch mechanism being actuable between an engaged configuration and a disengaged configuration by application of a force to said surface of said hand grip, said rotation mechanism configured to transmit a force applied to said surface of said hand grip to the outer surface of the upper pole portion to cause the upper pole portion to rotate.

30. The umbrella support of claim 29, further comprising:

a canopy; and a crank configured to open and close the canopy, and configured to rotate with the upper pole portion.

31. A method of rotating an umbrella, comprising:

providing an umbrella having a lower pole portion, an upper pole portion being coupled to said lower pole portion and having an outer surface, a canopy, and a rotation mechanism having a clutch and a hand grip, said hand grip being coupled to the upper pole portion, and having a gripping surface;

gripping said gripping surface to disengage the clutch;

twisting the upper pole portion by applying a force to said gripping surface while the clutch is disengaged to cause said rotation mechanism to transmit the force applied to the gripping surface of the hand grip to the outer surface of the upper pole portion;

wherein gripping and twisting are performed at the gripping surface of the rotation mechanism.

32. The method of claim 31, further comprising:

providing a crank coupled with the upper pole portion; and wherein the step of twisting the upper pole portion comprises twisting the crank about a longitudinal axis of the upper pole portion.

* * * * *

UNITED STATES PATENT AND TRADEMARK OFFICE

CERTIFICATE OF CORRECTION

PATENT NO. : 7,412,985 B2
APPLICATION NO. : 11/063234
DATED : August 19, 2008
INVENTOR(S) : Oliver Joen-an Ma It is certified that error appears in the above-identified patent and that said Letters Patent is hereby corrected as shown below:

On the title page, item [30] in Column 1, (under *Foreign Application Priority Data*), below "Jun. 8, 2004 (CN)" insert -- Jun. 24, 2004 (CN) 200410025699.3 --.

In Column 1, Line 6, delete "parent" and insert -- Patent --, therefor.

In Column 14, Line 3, in Claim 28, replace "a the" with -- the --.

Signed and Sealed this

Seventeenth Day of February, 2009

John Doll

JOHN DOLL
*Acting Director of the United States Patent and Trademark Office*